US006294847B1

(12) United States Patent
De Los Santos

(10) Patent No.: US 6,294,847 B1
(45) Date of Patent: Sep. 25, 2001

(54) BISTABLE MICRO-ELECTROMECHANICAL SWITCH

(75) Inventor: Hector J. De Los Santos, Inglewood, CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/439,233

(22) Filed: Nov. 12, 1999

(51) Int. Cl.[7] ..... H01P 1/10
(52) U.S. Cl. ..... 307/125; 333/262
(58) Field of Search ..... 307/125; 333/101, 333/105, 262; 200/131, 245, 246, 414, 421

(56) References Cited

U.S. PATENT DOCUMENTS 5,578,976 * 11/1996 Yao ..... 333/262
6,069,540 * 5/2000 Berenz et al. ..... 333/101

* cited by examiner

*Primary Examiner*—Josie Ballato
*Assistant Examiner*—Robert L. Deberadinis
(74) *Attorney, Agent, or Firm*—Terje Gudmestad

(57) ABSTRACT

A bistable micro-electromechanical switch (10) having two parallel plate capacitors (17, 19) spaced a distance from each other on a substrate (12). A transmission line (30), having a detached segment (22), that is movable or the substrate (12), is located on the substrate (12) between the parallel plate capacitors (17, 19). A dielectric beam (24) is attached to the movable transmission line segment (22) and the ends of the dielectric beam (24) protrude into each of the parallel plate capacitors (17, 19). When a voltage (26, 28) is applied to one of the capacitors (17 or 19), the dielectric beam (24) is pulled into the capacitor (17 or 19) and brings the movable transmission line segment (22) with it. As the transmission line segment (22) is moved either into, or out of, alignment with the transmission line (30), a path through the transmission line is either closed, or opened.

7 Claims, 2 Drawing Sheets

BISTABLE MICRO-ELECTROMECHANICAL SWITCH

TECHNICAL FIELD

The present invention relates to a micro-electromechanical switch and more particularly to a bistable micro-electromechanical switch having lateral transverse actuation.

BACKGROUND ART

Micro-electromechanical switches are used in a variety of applications and in particular for satellite communications systems with architecture that includes switching matrices and phased array antennas. It is desirable to have a switch having low-insertion loss, high isolation and high switching frequency.

Presently, the micro-electromechanical switches known in the prior art include a beam cantilevered from a switch base, or substrate. The beam acts as one plate of a parallel-plate capacitor. A voltage, known as an actuation voltage, is applied between the beam and an electrode on the switch base. In the switch-closing phase, or ON-state, the actuation voltage exerts an electrostatic force of attraction on the beam. As a result of the electrostatic force of attraction, the beam deflects and makes a connection with a contact on the switch base, closing the switch. Ideally, when the actuation voltage is removed, the beam will return to its natural state, breaking its connection with the contact electrode, thereby opening the switch.

The switch-opening phase, or OFF-state, is not directly controlled. It relies on the forces of nature embodied in the spring constant of the beam to effect the opening of the switch. Unfortunately, these forces are not always predictable and therefore unreliable.

For example, in some cases, once the actuation voltage is removed, stiction forces, (forces of attraction that cause the cantilevered beam to stick to the contact electrode), overcome the spring restoring force of the beam. The stiction force may cause the free end of the cantilevered beam to stick to the contact electrode and keep the switch closed when, in fact, it should be open.

Another problem associated with cantilever beam type switches is intrinsic to the beam's change of state from open to close. The operation of the beam is inherently unstable. When closing, the beam deforms gradually and predictably, up to a certain point, as a function of the actuation voltage being applied to the switch. Beyond that point, control is lost and the beam's operation becomes unstable, causing the beam to come crashing down onto the secondary electrode. This causes the beam to stick, or causes premature deterioration of the contact electrode. Both conditions impair the useful life of the switch and result in premature failure.

Prior art cantilever beam type switches require a trade-off between actuation voltage and isolation. For a low actuation voltage, the beam-to-substrate separation should be small. However, a small beam-to substrate separation results in a large parasitic capacitance, and thus a low isolation.

In addition, the maximum frequency at which the beam can deflect and relax is related to its geometry and material properties, such as length, bulk modulus, and density. Therefore, it may be impossible, in some applications, to achieve high switching frequencies at practical beam geometries.

SUMMARY OF THE INVENTION

The micro-electromechanical switch of the present invention exploits stiction forces to implement a bistable switch.

The present invention has a detached segment of transmission line that is coerced into lateral transverse motion between two parallel plate capacitors in order to make, or break, a connection between transmission line segments.

The present invention has a substrate supporting two electrodes spaced a distance from each other and a transmission line located in between the electrodes. The transmission line has a detached segment, or a bridge, that moves laterally between the two electrodes. A beam is attached to the detached segment. The beam is transverse to the detached segment and is aligned with the direction of movement of the segment. The beam is a dielectric material and intrudes into both parallel plate capacitors so that when a voltage is applied to either capacitor, it affects the beam and initiates movement of the detached segment.

To actuate the switch a voltage is applied to one of the parallel plate capacitors. The dielectric beam is pulled in the direction of the capacitor having the voltage applied thereto. When the segment is pulled towards the parallel plate capacitor, the transmission line is broken and the switch is opened.

The switch of the present invention is bistable. When the voltage is removed from the parallel plate capacitor, the transmission line segment remains in its position and doesn't move until a voltage is applied to the opposite parallel plate capacitor, thereby drawing the segment back in line with the transmission line, closing the switch.

It is an object of the present invention to overcome the drawbacks associated with cantilever beam type switches. It is another object of the present invention to maintain indifference to resonant frequency.

It is a further object of the present invention to have a very low actuation voltage. It is yet a further object of the present invention to exhibit isolation that is not compromised by a low actuation voltage.

Other objects and features of the present invention will become apparent when viewed in light of the detailed description of the preferred embodiment when taken in conjunction with the attached drawings and appended claims.

BEST MODE(S) FOR CARRYING OUT THE INVENTION

Figure 1:
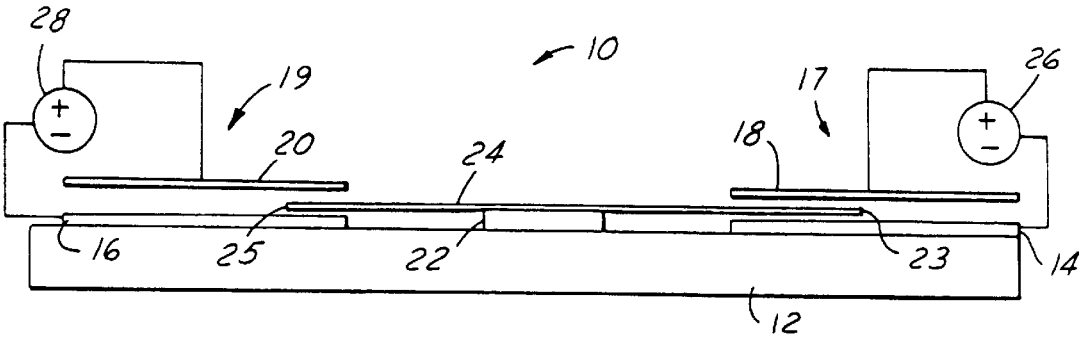
FIG. 1 is a cut-away side view of a bistable MEM switch of the present invention.

A micro-electromechanical switch 10 of the present invention is shown in FIGS. 1 through 7. Referring specifically to FIG. 1, a cross-sectional view of the switch is shown. A substrate 12 supports first bottom electrode 14 and second bottom electrode 16. Also on the substrate 12, and spaced a distance above the first bottom electrode 14 and the second bottom electrode 16, are first top electrode 18 and second top electrode 20.

A segment of transmission line 22 is shown between the first bottom electrode 14 and the second bottom electrode 16. The segment of transmission line 22 is movable, laterally along the substrate 12 between the first and second bottom electrodes 14, 16 in both directions.

A dielectric beam 24 is supported by the segment of transmission line 22. A first end 23 of the beam 24 intrudes into the space between the first top electrode 18 and the first bottom electrode 14. Likewise, a second end 25 of the beam 24 intrudes into the space between the second top 20 and bottom 16 electrodes.

Figure 2:
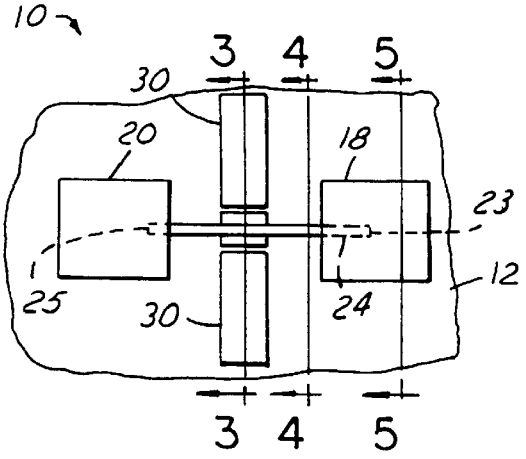
FIG. 2 is a top view of the switch of the present invention.

Referring now to FIG. 2, a top view of the switch 10 of the present invention is shown. An entire length of transmission line 30 is shown along with the detached segment 22. The segment 22 of transmission line is shown aligned with the entire transmission line 30. In this position, the path through the transmission line 30 is complete and the switch 10 is closed.

Figure 3:
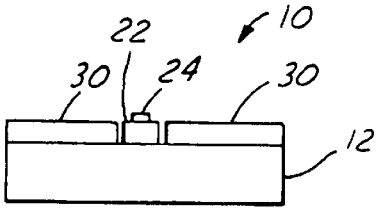
FIG. 3 is a cross-sectional view, taken along line 3—3 in FIG. 2.
Figure 4:
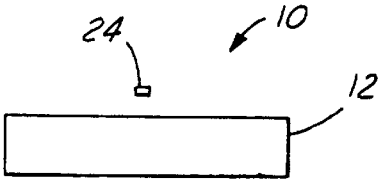
FIG. 4 is a cross-sectional view, taken along line 4—4 in FIG. 2.
Figure 5:
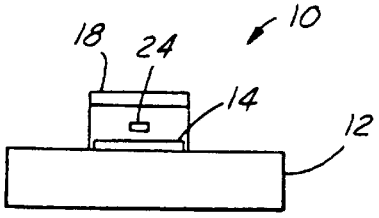
FIG. 5 is a cross-sectional view, taken along line 5—5 in FIG. 2

FIG. 3 is a cross sectional view of the switch through line 3—3 in FIG. 2 and highlights the structural relationship among the transmission line 30, the segment 22, and the beam 24 on the substrate 12. FIG. 4 is a cross section, taken along line 4—4 in FIG. 2, showing the substrate 12 in relation to the beam 24. FIG. 5 is a cross-sectional view of the switch 10 taken along line 5—5 in FIG. 2 showing the first top electrode 18 and the first bottom electrode 14 and the beam 24 located between the electrodes 14 and 18.

Referring again to FIG. 1, the first top 18 and bottom 14 electrodes define a first parallel plate capacitor 17 and the second top 20 and bottom 16 electrodes define a second parallel plate capacitor 19. First 26 and second 28 voltage sources are shown at the first 17 and second 19 parallel plate capacitors respectively.

Figure 6:
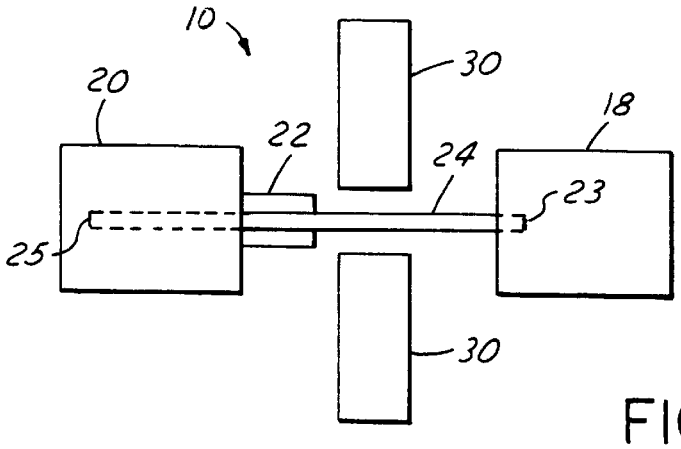
FIG. 6 is a top view of the switch of the present invention in the open position.
Figure 7:
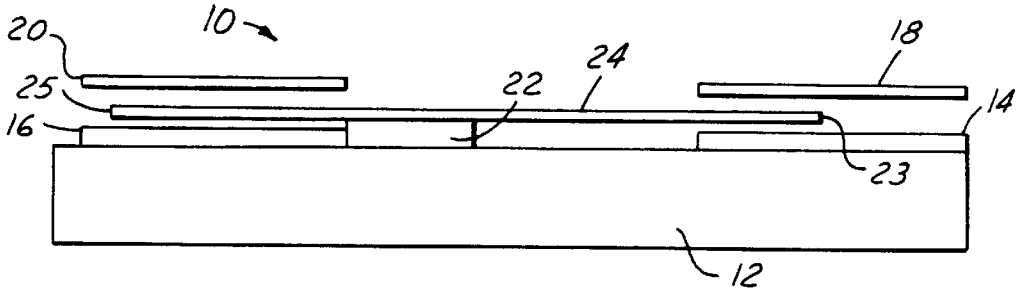
FIG. 7 is a cut-away side view of the switch of the present invention in the open position.

The application of a voltage to either the first or second capacitors actuates the switch 10. To open the switch, a voltage is applied to the second parallel plate capacitor 19, and there is no voltage applied at the first parallel plate capacitor 17. The end 25 of the beam 24 slightly protruding into the second parallel plate capacitor 19 experiences a force that pulls the beam 24 further into the second capacitor 19, sliding the transmission line segment 22 laterally along the substrate 12. The transmission line segment 22 is no longer aligned with the transmission line 30. The path through the transmission line is broken, opening the switch. FIG. 6 is a top view of the switch in the open position. FIG. 7 is a cut-away side view of the switch 10 in the open position.

As shown in FIG. 7, the movable segment of transmission line 22 is stopped from moving when it abuts the bottom electrode 16. The value of the actuation voltage has a direct bearing on the pulling force applied to the dielectric beam. It is possible to limit the actuation voltage so that the transmission line segment 22 moves a predetermined distance that is sufficient to break the path through the transmission line 30.

Figure 8:
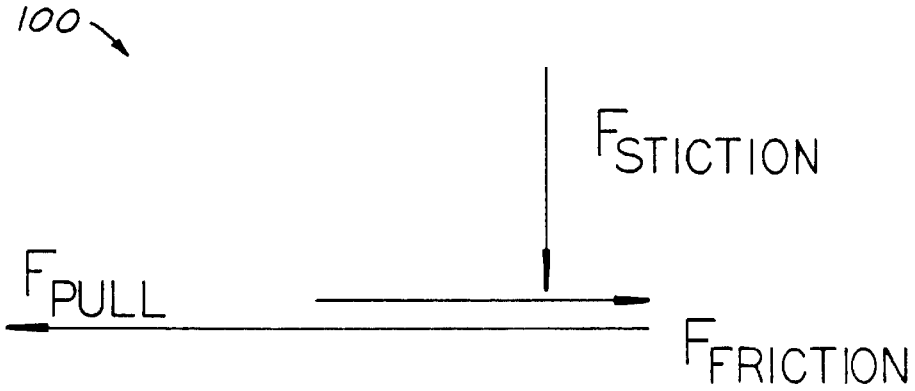
FIG. 8 is a vector diagram of the forces acting on the detached segment of transmission line during actuation of the switch of the present invention.

The operation of the switch is described with reference to the vector diagram 100 of the forces involved, as shown in FIG. 8. There is a friction force, $F_{FRICTION}$, which acts on the transmission line segment between the segment and the substrate. In addition, a stiction force, $F_{STICTION}$, is acting downward on the segment. Because the movement of the segment is lateral, the only force to overcome is the frictional force. When a voltage is applied at one of the parallel plate capacitors a force, shown by $F_{PULL}$, pulls the beam further into the capacitor. The pull force easily overcomes the frictional force, thereby sliding the segment in the direction of the pull force.

The pulling force is defined by:

$$F=[b/(2d_1)][((\in-\in_o)*V^2]$$

Where b is the width of the dielectric beam, $d_1$ is the thickness of the dielectric beam, (roughly equal to the gap in the parallel plate capacitor), and $\in$ and $\in_o$ are the dielectric constants of the beam and air respectively.

The stiction force, usually a source of problems for prior art cantilever beam type switches, enhances the action of the switch 10 of the present invention. The stiction force is vertical, keeping the segment compliant with the substrate. The resistance is the lateral force of friction, which is much less than the stiction force. Because friction is a shear-like force, it is easily overcome. Upon application of a predetermined voltage, the movable transmission line segment will easily slide so as to close, or open, the gap in the transmission line, thereby closing or opening the path through the line.

The segment of transmission line 22 will move in the direction of the parallel plate capacitor having a voltage applied thereto. The segment will move in either direction. The switch is open when the transmission line segment 22 is to one side of the transmission line 30 and the switch is closed when the segment 22 is aligned with the transmission line 30.

The switch 10 of the present invention is a bistable switch. When the voltage is removed, the stiction forces keep the transmission line segment in place. Therefore, the switch remains in the desired position even after the voltage is removed. The switch positions can be verified, making the switch very desirable for space applications.

The switching action is a function of the switch mass and the friction force only. Therefore, the actuation voltage can be very low. In addition, the movable transmission line segment can be any desired length, allowing the parasitic open-state capacitance to be made as small as desired, without affecting the actuation voltage.

The switch of the present invention is not characterized by a resonant frequency due to the absence of any spring-mass type system in the switch's operation. Because there is no spring-like restoring force component, the switching operation does not contain oscillatory vibrations, thereby improving the switching time over prior art MEM switches.

The switch of the present invention is a low-insertion loss, high-isolation, high switching frequency microwave switch that overcomes many of the drawbacks associated with prior art MEM switches.

While particular embodiments of the invention have been shown and described, numerous variations and alternate embodiments will occur to those skilled in the art. Accordingly, it is intended that the invention be limited only in terms of the appended claims.

What is claimed is:

1. A bistable micro-electromechanical switch comprising:

a substrate having a first end and a second end;

a first parallel plate capacitor located on said first end of said substrate;

a second parallel plate capacitor located on said second end of said substrate;

a transmission line located on said substrate between said first and second parallel plate capacitors, said transmission line having a detached segment that is movable in a transverse lateral direction between said first and second parallel plate capacitors;

a dielectric beam attached to said detached segment of transmission line, said dielectric beam having a first end positioned between said first parallel plate capacitor and a second end positioned between said second parallel plate capacitor;

whereby when said switch is actuated by a voltage applied to one of said first and second parallel plate capacitors, a force is created on said dielectric beam pulling said beam toward said one parallel plate capacitor and causing said detached segment of transmission line to move in the laterally transverse direction of the parallel plate capacitor having a voltage applied thereto.

2. The switch as claimed in claim 1 wherein said first and second parallel plate capacitors further comprise:

a bottom electrode attached to said substrate; and a top electrode supported by said base and located a distance above said bottom electrode, said top and bottom electrodes defining a gap therebetween.

3. The switch as claimed in claim 2 wherein said dielectric beam has a thickness that is approximately equal to said gap between said first and second electrodes.

4. The switch as claimed in claim 1 wherein said switch is opened by said detached transmission line segment moving out of lateral alignment with said transmission line and creating a gap in said path through said transmission line.

5. The switch as claimed in claim 1 wherein said switch is closed by said transmission line segment moving into lateral alignment with said transmission line and closing a gap in said path through said transmission line.

6. The switch as claimed in claim 1 wherein said detached segment of transmission line is stopped from moving by coming in contact with one of said parallel plate capacitors.

7. The switch as claimed in claim 1 wherein said detached segment of transmission line is stopped from moving by applying a predetermined actuation voltage to define a predetermined distance of travel for said detached segment.

* * * * *